US008011756B2

(12) United States Patent
Ike et al.

(10) Patent No.: US 8,011,756 B2
(45) Date of Patent: Sep. 6, 2011

(54) IMAGING METHOD AND INKJET RECORDING APPARATUS

(75) Inventors: Takahiro Ike, Tokyo (JP); Yoshihisa Ohta, Tokyo (JP); Masakazu Yoshida, Kanagawa (JP); Takashi Kimura, Kanagawa (JP); Masanori Hirano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 844 days.

(21) Appl. No.: 11/662,821

(22) PCT Filed: Jun. 23, 2006

(86) PCT No.: PCT/JP2006/313044

§ 371 (c)(1),
(2), (4) Date: Mar. 13, 2007

(87) PCT Pub. No.: WO2007/010726

PCT Pub. Date: Jan. 25, 2007

(65) Prior Publication Data

US 2009/0051734 A1 Feb. 26, 2009

(30) Foreign Application Priority Data

Jul. 22, 2005 (JP) ..... 2005-212620

(51) Int. Cl.
*B41J 2/21* (2006.01)

(52) U.S. Cl. ..... 347/43

(58) Field of Classification Search ..... 347/40–47
See application file for complete search history.

(56) References Cited

U.S. PATENT DOCUMENTS

| | | | | |
|---|---|---|---|---|
| 5,452,385 | A * | 9/1995 | Izumi et al. | 385/37 |
| 5,699,492 | A | 12/1997 | Karaki | |
| 6,290,329 | B1 * | 9/2001 | Terasawa et al. | 347/43 |
| 6,565,191 | B1 * | 5/2003 | Bolash et al. | 347/40 |
| 6,637,861 | B2 * | 10/2003 | Yamamoto | 347/43 |
| 6,776,468 | B2 * | 8/2004 | Miller et al. | 347/9 |
| 6,883,898 | B2 * | 4/2005 | Sato | 347/40 |
| 6,966,626 | B2 * | 11/2005 | Hayashi | 347/41 |
| 7,168,786 | B2 * | 1/2007 | Tanaka et al. | 347/43 |
| 7,252,364 | B2 * | 8/2007 | Chikuma et al. | 347/41 |
| 7,350,902 | B2 * | 4/2008 | Dietl et al. | 347/43 |
| 2002/0021319 | A1 * | 2/2002 | Kawatoko et al. | 347/15 |
| 2004/0080762 | A1 | 4/2004 | Kroon | |

(Continued)

FOREIGN PATENT DOCUMENTS

EP 0707281 A2 4/1996

(Continued)

OTHER PUBLICATIONS

Dec. 4, 2008 search report in connection with a counterpart European patent application No. 06 78 0676.

*Primary Examiner* — Charlie Peng
(74) *Attorney, Agent, or Firm* — Cooper & Dunham LLP

(57) ABSTRACT

An imaging method is disclosed for realizing full color printing using an ink head configured to discharge black ink and a plurality of color inks. The imaging method involves printing a monochrome image portion by printing a plurality of first rasters using black ink and an arbitrary number of the color inks, and printing a second raster in between the first rasters using pseudo black ink that is realized by the remaining number of the color inks.

18 Claims, 15 Drawing Sheets

U.S. PATENT DOCUMENTS

| | | | | |
|---|---|---|---|---|
| 2006/0139387 | A1 * | 6/2006 | Silverbrook et al. | 347/13 |

FOREIGN PATENT DOCUMENTS

| | | | |
|---|---|---|---|
| EP | 1414232 | A2 | 4/2004 |
| JP | 2-26753 | | 1/1990 |
| JP | 10-264372 | | 10/1998 |
| JP | 2001-260423 | | 9/2001 |
| JP | 2003-62986 | | 3/2003 |
| JP | 3533771 | | 3/2004 |
| JP | 2004-195860 | | 7/2004 |
| JP | 2005-53147 | | 3/2005 |
| JP | 2005-169678 | | 6/2005 |

* cited by examiner

FIG.8A

| | INK DROPLET SIZES WHEN BLACK IS LARGE | | | | |
|---|---|---|---|---|---|
| | RASTER OF BLACK | | RASTER WITHOUT BLACK | | |
| OPTION | BLACK (K) | YELLOW (Y) | CYAN (C) | MAGENTA (M) | |
| 1 | LARGE | LARGE | LARGE | LARGE | PRIORITIZING IMAGE DENSITY |
| 2 | LARGE | MEDIUM/ SMALL/NULL | LARGE | LARGE | REDUCING INK CONSUMPTION AMOUNT |
| 3 | LARGE | MEDIUM | MEDIUM | MEDIUM | PREVENTING GRAY BALANCE DEVIATION |
| 4 | LARGE | SMALL/ NULL | MEDIUM | MEDIUM | PREVENTING GRAY BALANCE DEVIATION AND REDUCING INK CONSUMPTION AMOUNT |
| 5 | LARGE | MEDIUM/ SMALL/NULL | SMALL | SMALL | FURTHER REDUCING INK CONSUMPTION AMOUNT |

FIG.8B

| | INK DROPLET SIZES WHEN BLACK IS MEDIUM | | | | |
|---|---|---|---|---|---|
| | RASTER OF BLACK | | RASTER WITHOUT BLACK | | |
| OPTION | BLACK (K) | YELLOW (Y) | CYAN (C) | MAGENTA (M) | |
| 1 | MEDIUM | MEDIUM | MEDIUM | MEDIUM | PRIORITIZING IMAGE DENSITY |
| 2 | MEDIUM | SMALL/NULL | MEDIUM | MEDIUM | REDUCING INK CONSUMPTION AMOUNT |
| 3 | MEDIUM | MEDIUM/ SMALL/NULL | SMALL | SMALL | PREVENTING GRAY BALANCE DEVIATION AND REDUCING INK CONSUMPTION AMOUNT |

FIG.8C

| | INK DROPLET SIZES WHEN BLACK IS SMALL | | | | |
|---|---|---|---|---|---|
| | RASTER OF BLACK | | RASTER WITHOUT BLACK | | |
| OPTION | BLACK (K) | YELLOW (Y) | CYAN (C) | MAGENTA (M) | |
| 1 | SMALL | SMALL | SMALL | SMALL | PRIORITIZING IMAGE DENSITY |
| 2 | SMALL | NULL | SMALL | SMALL | REDUCING INK CONSUMPTION AMOUNT |
| 3 | SMALL | NULL | NULL | NULL | PREVENTING GRAY BALANCE DEVIATION AND REDUCING INK CONSUMPTION AMOUNT |

FIG.9A

| | INK DROPLET SIZES WHEN BLACK IS LARGE | | | | TOTAL INK CONSUMPTION AMOUNT (pl) |
|---|---|---|---|---|---|
| | RASTER OF BLACK | | RASTER WITHOUT BLACK | | |
| OPTION | BLACK (K) | YELLOW (Y) | CYAN (C) | MAGENTA (M) | |
| 1 | LARGE | LARGE | LARGE | LARGE | 120 |
| 2 | LARGE | MEDIUM | MEDIUM | MEDIUM | 69 |
| 3 | LARGE | SMALL | MEDIUM | MEDIUM | 60 |
| 4 | LARGE | SMALL | SMALL | SMALL | 42 |

FIG.9B

MONOCHROME

| | PRINTING AT 300 DPI USING ONLY BLACK (K) | | | | TOTAL INK CONSUMPTION AMOUNT (pl) |
|---|---|---|---|---|---|
| | BLACK (K) | BLACK (K) | | | |
| 1 | LARGE | | LARGE | | 60 |

LARGE=30pl, MEDIUM=13pl, SMALL=4pl

FIG.14

| | PRINTING MODE | SUB MODE | RESOLUTION (HORIZONTAL × VERTICAL) | | MULTIVALUE | SCAN NUMBER | REMARKS |
|---|---|---|---|---|---|---|---|
| | | | BLACK DATA | COLOR DATA | | | |
| ① | HIGH SPEED | SPEED EMPHASIS | PSEUDO BLACK 300 × 300 | 300 × 300 | FOUR-VALUE | 1 | MAXIMUM SPEED |
| | | BALANCE | PSEUDO BLACK 300 × 300 | 300 × 300 | FOUR-VALUE | BLACK PORTION: 1 COLOR POTION: 2 | |
| | | IMAGE QUALITY EMPHASIS | 300 × 300 | 300 × 300 | FOUR-VALUE | 2 | |
| ② | STANDARD (SPEEDY) | | 600 × 300 | 600 × 300 | FOUR-VALUE | 2 | |
| ③ | STANDARD (FINE) | | 600 × 600 | 600 × 600 | FOUR-VALUE | 4 | |
| ④ | HIGH IMAGE QUALITY | | 1200 × 1200 | 1200 × 1200 | FOUR-VALUE | 8 | MAXIMUM IMAGE QUALITY |

IMAGING METHOD AND INKJET RECORDING APPARATUS

TECHNICAL FIELD

The present invention relates generally to an imaging method and an inkjet recording apparatus, and particularly to an image processing technique used in an inkjet recording apparatus that involves recording an image using a recording head configured to discharge ink.

BACKGROUND ART

An inkjet recording apparatus is configured to print an image through inkjet recording to thereby realize high quality imaging at relatively low cost. With the widespread use of the personal computer, the inkjet recording apparatus is becoming commonly used as a color image output apparatus for the personal computer.

An inkjet recording head used in such an inkjet recording apparatus has plural nozzles arranged in the sub scanning direction (i.e., traveling direction of recording paper), and is moved in the main scanning direction (i.e., direction perpendicular to the traveling direction of recording paper) by a carriage mechanism. The nozzles of the inkjet recording head are configured to discharge ink droplets at appropriate timings according to dot pattern data obtained by developing print data. In this way, the ink droplets discharged from the nozzles are adhered to recording paper to thereby realize image printing.

As is described above, the inkjet recording apparatus may be used as an output apparatus of a personal computer. In this respect, techniques for increasing the recording speed, improving the image quality, reducing the apparatus size, and reducing the apparatus cost are in demand. It is noted that speed increase may be realized by increasing the ink discharge drive frequency, increasing the number of nozzles, or printing at a lower resolution in a case where the printing resolution is higher than the nozzle resolution, for example. Image quality improvement may be realized by miniaturizing the nozzles or increasing the printing resolution, for example.

In order to realize speed increase and image quality improvement at the same time, the number of nozzles may be increased to realize high resolution printing with small dots. However, it is noted that by increasing the number of nozzles, the size of the inkjet recording head is increased to thereby cause cost increase. Also, it is noted that an increase in the size of the recording head may lead to an increase in the overall size of the inkjet recording apparatus, an increase in the amount of vibrations and noise upon moving the recording head, and an increase in the power consumption amount, for example. As can be appreciated from the above descriptions, speed increase and image quality improvement are in a tradeoff relationship.

In this respect, use of a technique that involves superficially increasing the resolution by adjusting the arrangement of nozzles is being proposed (e.g., see Japanese Laid-Open Patent Publication No. 2-26753, Japanese Patent No. 3,533,771, and Japanese Laid-Open Patent Publication No. 2001-260423). It is noted that this technique has been developed in view of the demand for higher resolution and the fact that monochrome printing is generally used more often than color printing. According to this technique, nozzles of the three primary colors (magenta, cyan, yellow) are arranged on the same scanning lines that are shifted from the positions of black nozzles by ½ the nozzle pitch. With such an arrangement, in the case of performing monochrome image printing, black realized by black ink and composite black realized by combining the three primary color inks may be used for printing a monochrome image so that the printing resolution for monochrome image printing may be double the printing resolution for color image printing without causing a decrease in the printing speed.

Also, in order to miniaturize the head size and increase the nozzle density, two rows of nozzles may be staggered with respect to each other. Such a nozzle arrangement is particularly applied to a piezoelectric recording head, which has relatively large piezoelectric elements so that densification of the nozzles is highly demanded.

According to the technique disclosed in the above-cited documents, composite black is used in addition to black from black ink, and the three primary color nozzles are arranged on the same scanning lines while the black ink nozzles are shifted by ½ the nozzle pitch from the scanning line positions of the primary color nozzles. Therefore, the technique of staggering the nozzles of one nozzle row with respect to the nozzles of another nozzle row to increase the nozzle density and miniaturize the head size may not be combined with the above technique for realizing high quality imaging at high speed. In other words, nozzle densification/head miniaturization and high-quality/high-speed printing cannot be realized at the same time based on the above-described techniques.

DISCLOSURE OF THE INVENTION

According to an aspect of the present invention, an imaging method and an inkjet recording apparatus are provided that can realize high-speed/high-quality imaging and head miniaturization at the same time.

According to one specific embodiment of the present invention an imaging method is provided for realizing full color printing using an ink head configured to discharge black ink and a plurality of color inks, the method including:

printing a monochrome image portion by printing a plurality of first rasters using the black ink and an arbitrary number of the color inks, and printing a second raster in between the first rasters using pseudo black ink that is realized by a remaining number of the color inks. According to one aspect of the present embodiment, high speed/high quality printing may be realized without increasing the head size.

In one preferred embodiment, the first rasters are printed using the arbitrary number of the color inks to adjust a gray balance with respect to the second raster printed using the pseudo black ink.

In another preferred embodiment, switching is performed between printing the monochrome image portion using the black ink and the arbitrary number of the color inks, and printing the monochrome image portion using the black ink, the arbitrary number of the color inks, and the pseudo black ink depending on the image object type of the monochrome image portion. According to one aspect of the present embodiment, in a case where color portions and monochrome portions are intermingled within an image object, the monochrome portion of the image object may be printed at the same resolution as the color portion of the image in order to prevent an awkward appearance of the overall image, for example.

In another preferred embodiment, the monochrome image portion is printed using the black ink and the pseudo black ink in a case where the monochrome image portion corresponds to at least one of a character or a line.

In another preferred embodiment, in a case where the ink head is configured to adjust ink droplet sizes of the black ink and the color inks, the ink droplet size of the black ink is arranged to be greater than or equal to the ink droplet sizes of the color inks upon printing the monochrome image portion. According to one aspect of the present embodiment, gray balance deviations in the monochrome image printed using the pseudo black ink may be reduced, for example.

In another preferred embodiment, the ink droplet sizes of the color inks are determined based on a dot arrangement pattern of the monochrome image portion. According to one aspect of the present embodiment, color ink dots printed as pseudo black ink dots of the monochrome image may be prevented from standing out.

In another preferred embodiment, the monochrome image portion is printed at a sub scanning resolution that is double a color image sub scanning resolution for printing a color image portion.

In another preferred embodiment, the number of scans performed by the ink head in the main scanning direction is changed depending on whether the monochrome image portion is printed or a color image portion is printed.

In another preferred embodiment, a dot printed using the pseudo black ink is positioned adjacent to a dot printed using the black ink, or the pseudo black ink dot is positioned in between two dots printed using the black ink.

According to another specific embodiment of the present invention, an inkjet recording apparatus is provided that forms an image on a recording medium, the apparatus including:

an ink head configured to discharge black ink and a plurality of color inks while moving back and forth in a main scanning direction that is perpendicular to a sub scanning direction corresponding to a conveying direction of the recording medium;

wherein the ink head includes a first nozzle row group and a second nozzle row group, the first nozzle row group including a black nozzle row having black nozzles for discharging the black ink and at least one color nozzle row having color nozzles for discharging at least one color ink of the color inks, the black nozzles of the black nozzle row and the color nozzles of the at least one color nozzle row being arranged at first raster positions with respect to the sub scanning direction, and the second nozzle row group including a plurality of color nozzle rows having color nozzles for discharging the color inks other than the at least one color ink to be discharged by the first nozzle row group, the color nozzles of the second nozzle row group being arranged at second raster positions that are shifted from the first raster positions in the sub scanning direction by half a nozzle pitch; and the second nozzle row group is configured to perform pseudo black printing by printing a color dot as a pseudo black dot substituting a black dot of a monochrome image portion using at least two of the color-nozzles positioned at a corresponding raster position of the black dot. According to one aspect of the present embodiment, an inkjet apparatus with a relatively simple configuration is provided that is capable of realizing high speed/high quality printing and miniaturization at the same time.

In a preferred embodiment, the color ink discharged by the color nozzles of the color nozzle row of the first nozzle row group corresponds to one of magenta ink, cyan ink, or yellow ink.

In another preferred embodiment, the color nozzles of the at least one color nozzle row of the first nozzle row group are used to adjust a gray balance of the monochrome image portion.

In another preferred embodiment, switching is performed between printing the monochrome image using the first nozzle row group and printing the monochrome image portion using the first nozzle row group and the second nozzle row group depending on an image object type of the monochrome image portion. According to one aspect of the present embodiment, in a case where a color portion and a monochrome portion are intermingled within an image object, the monochrome portion may be printed at the same resolution as the color portion in order to prevent an awkward appearance of the overall image, for example.

In another preferred embodiment, the monochrome image portion is printed using the first nozzle row group and the second nozzle row group in a case where the monochrome image portion corresponds to at least one of a character or a line.

In another preferred embodiment, in a case where the ink head is configured to adjust ink droplet sizes of the black ink and the color inks, the ink droplet size of the black ink is arranged to be greater than or equal to the ink droplet sizes of the color inks. According to one aspect of the present embodiment, gray balance deviations may be reduced in the monochrome image portion printed using pseudo black printing, for example.

In another preferred embodiment, the ink droplet sizes of the color inks to be discharged by the color nozzles are determined based on a dot arrangement pattern of the monochrome image portion. According to one aspect of the present embodiment, the color dot printed as the pseudo black dot may be prevented from standing out in the monochrome image portion, for example.

In another preferred embodiment, the sub scanning resolution of the monochrome image portion is arranged to be at least double the color image sub scanning resolution for printing a color image portion.

In another preferred embodiment, the number of scans performed by the ink head in the main scanning direction is changed depending on whether the monochrome image portion is printed or a color image portion is printed.

In another preferred embodiment, the color dot printed as the pseudo black dot by the second nozzle row group through pseudo black printing is arranged to be adjacent to a black dot printed with black ink by the first nozzle row group.

BRIEF DESCRIPTION OF THE DRAWINGS

Other objects, features and advantages of the present invention will become more apparent from the following detailed description when read in conjunction with the accompanying drawings.

FIGS. 8A-8C are tables indicating preferred ink droplet sizes according to various conditions in the case of using the imaging method of the present embodiment;

FIGS. 9A and 9B are tables indicating total ink consumption amounts in the case of using the imaging method of the present embodiment and in the case of simply using black ink;

FIG. 14 is a table indicating set values for different printing modes realized using the imaging method of the present embodiment.

BEST MODE FOR CARRYING OUT THE INVENTION

In the following, preferred embodiments of the present invention are described with reference to the accompanying drawings.

Figure 1:
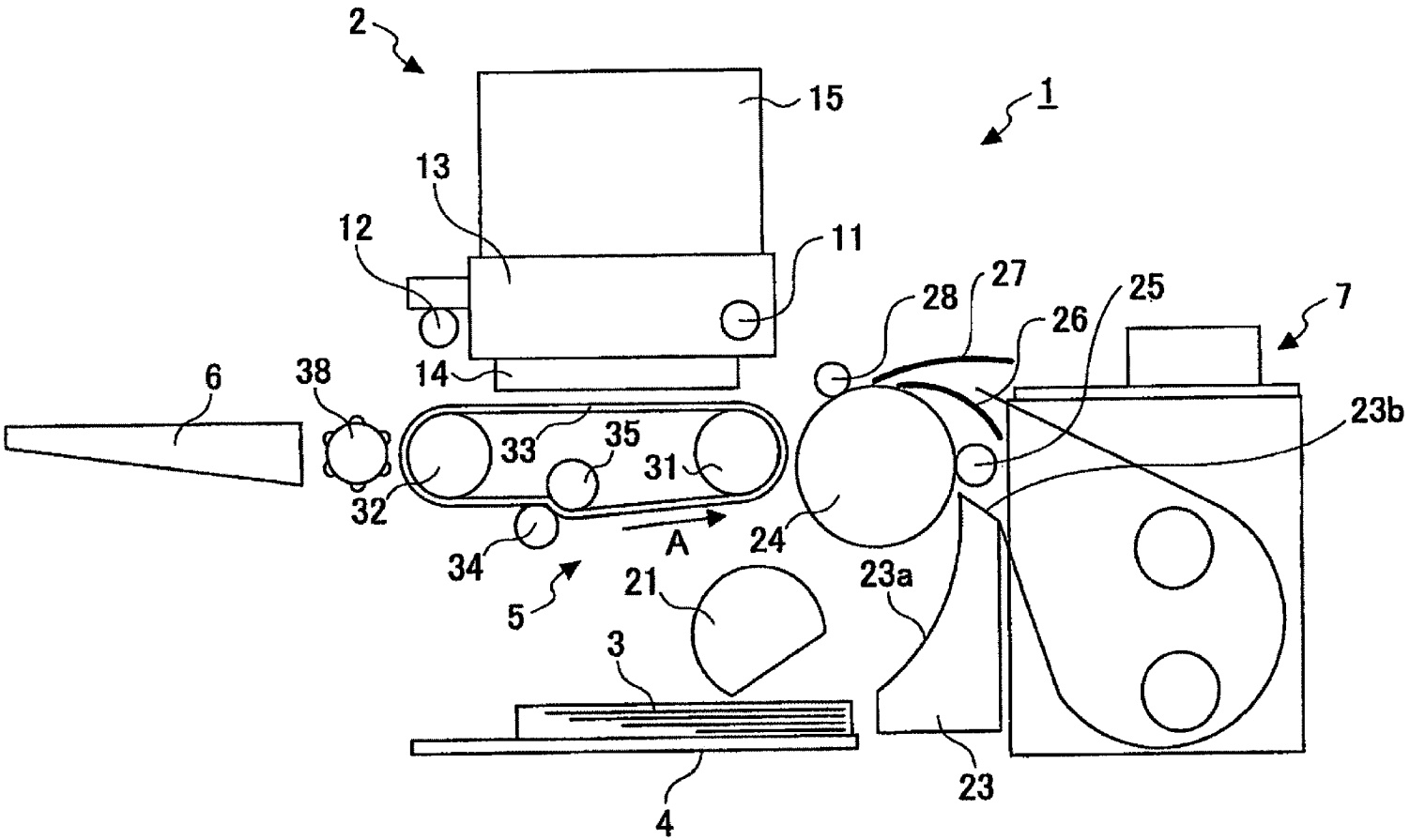
FIG. 1 is a cross-sectional diagram showing a configuration of an inkjet recording apparatus corresponding to an image recording apparatus according to an embodiment of the present invention.

FIG. 1 is a diagram showing a configuration of an inkjet recording apparatus that uses an imaging method according to an embodiment of the present invention. As is shown in this drawing, the inkjet recording apparatus includes an apparatus main frame 1, an imaging unit 2 that is accommodated within the apparatus main frame 1, a paper feeding tray 4 arranged at the lower side of the apparatus main frame that accommodates plural sheets of recording paper (recording medium) 3, a conveying mechanism 5 that conveys the recording paper 3 that is fed from the paper feeding tray 4 to the imaging unit 2, and a delivery tray 6 arranged at the side of the apparatus main frame 1 to which the recording paper 3 is delivered after an image is recorded thereon by the imaging unit 2.

It is noted that the illustrated inkjet recording apparatus also includes a dual-side printing unit 7 that may be detached from the apparatus main frame 1. The dual-side printing unit 7 is used upon performing dual side printing. In this case, after an image is printed on one side of the recording paper 3, the conveying mechanism 5 conveys the recording paper in a reverse direction so that the recording paper 3 may be fed into the dual-side printing unit 7. In turn, the dual-side printing unit 7 turns the recording paper 3 to the other side and feeds the overturned recording paper 3 to the conveying mechanism 5 so that an image may be printed on the other side of the recording paper 3 to then be delivered to the delivery tray 6.

Figure 2:
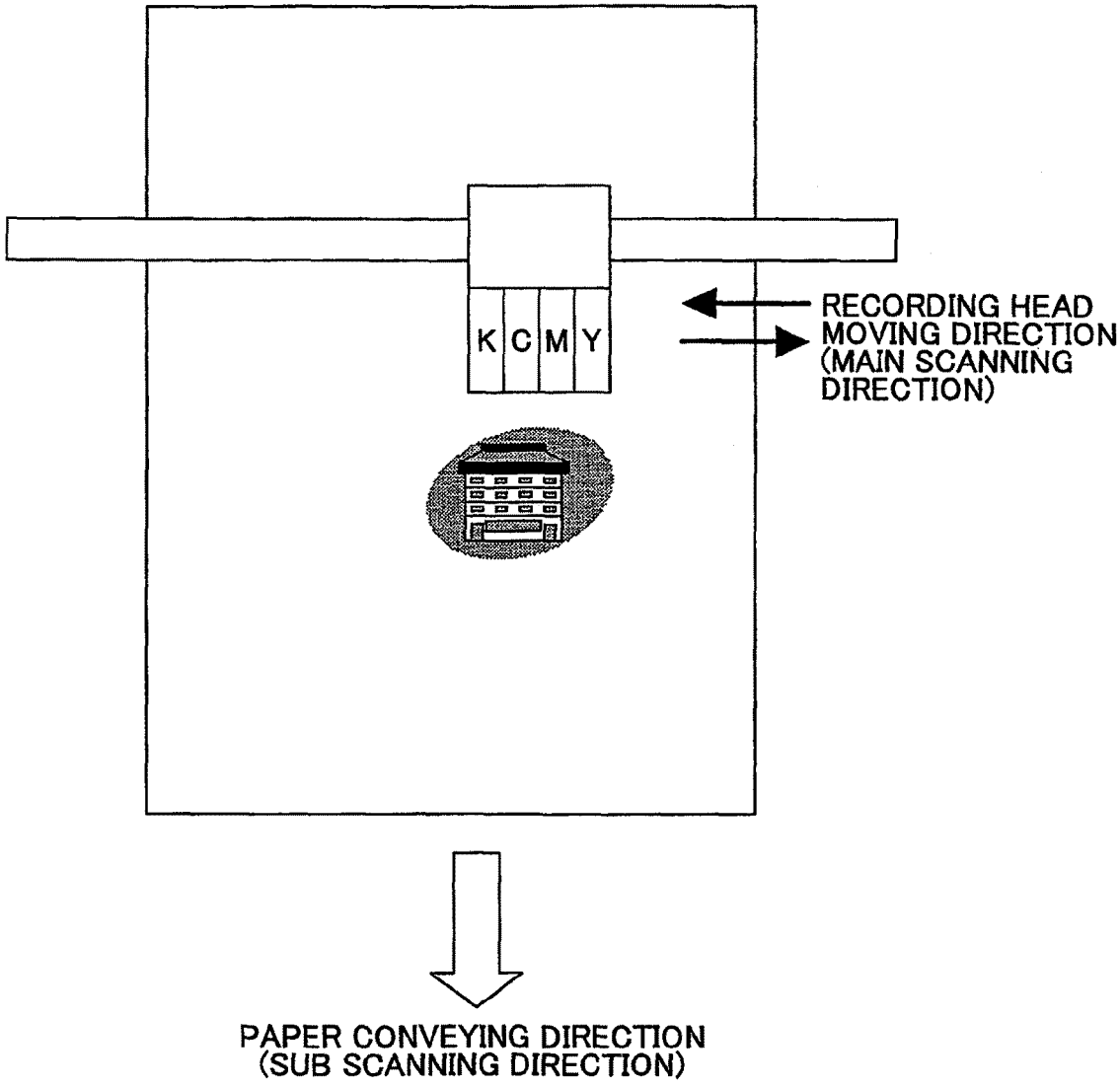
FIG. 2 is a diagram illustrating a mechanism of the inkjet recording apparatus of FIG. 1.

The imaging unit 2 includes guide shafts 11, 12, and a carriage 13 that is supported by the guide shafts 11 and 12 so that it may slide along the guide shafts 11 and 12. The carriage 13 is moved by a main scanning motor (not shown) in a direction perpendicular to the conveying direction of the recording paper 3 (main scanning direction). It is noted that the recording paper conveying direction and the carriage moving direction are illustrated in FIG. 2. As is shown in FIG. 1, the carriage 13 includes a recording head 14 corresponding to an ink discharge head that has plural nozzle holes as ink discharge outlets arranged thereon. Also, an ink cartridge 15 is detachably arranged on the recording head 14 to supply liquid (ink) to the recording head 14. It is noted that in one alternative example, the ink cartridge 15 may be replaced by a sub tank, and the sub tank may be configured to have ink supplied thereto from a main tank.

In one example, the recording head 14 may comprise four inkjet heads that are configured to discharge ink droplet of colors black (K), cyan (C), magenta (M), and yellow (Y), respectively. In another example, the recording head 14 may comprise a single inkjet head having plural nozzle rows that are configured to discharge ink droplets in the respective colors. It is noted that the number of colors and the arrangement order of the nozzles are not limited to the illustrated examples.

Also, the inkjet head realizing the recording head 14 may include energy generating means for discharging ink such as a piezoelectric element (e.g., piezoelectric actuator) a thermal actuator that uses an electro-thermal converting element such as a heat resistive element and relies on phase change caused by liquid film boiling, a shape-memory metal alloy actuator that relies on metal phase change caused by temperature change, or an electrostatic actuator that relies on electrostatic power.

The recording paper 3 accommodated in the paper feeding tray 4 is arranged to be fed into the apparatus main frame 1 one sheet at a time by a paper feeding roller 21 and a separating pad (not shown) to be conveyed by the conveying mechanism 5.

The conveying mechanism 5 includes a conveying guide unit 23 that is configured to guide the recording paper 3 fed from the paper feeding tray 3 in an upward direction along a guide surface 23*a*, and guide the recording paper 3 conveyed from the dual-side printing unit 7 along a guide surface 23*b*, a conveying roller 24 for conveying the recording paper 3, a pressure roller 25 that pushes the recording paper 3 onto the conveying roller 24, a guide member 26 that guides the recording paper 3 toward the conveying roller 24, a guide member 27 that guides the recording paper 3 subject to dual-side printing to the dual-side printing unit 7 to be overturned and fed back into the conveying mechanism 5, and a push roller 28 that pushes the recording paper 3 being conveyed away from the conveying roller 24.

The conveying mechanism 5 also includes a drive roller 31, a driven roller 32, a conveying belt 33 that is arranged around the drive roller 31 and the driven roller 32, a charge roller 34 for charging the conveying belt 33, a guide roller arranged opposite the charge roller 34, a guide plate or platen plate (not shown) that guides the conveying belt 33 at a region opposite the imaging unit 2, a cleaning roller corresponding to cleaning means for removing recording liquid (ink) adhered to the conveying belt 33 that may be made of porous material, for example.

Figure 3:
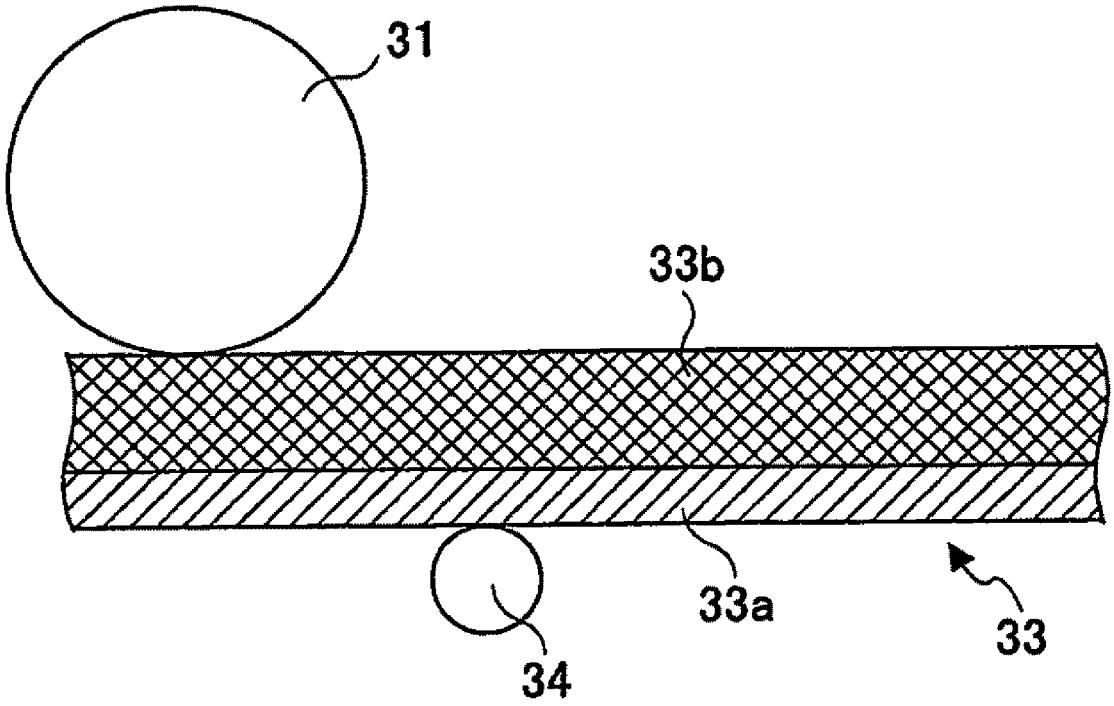
FIG. 3 is a cross-sectional diagram showing a configuration of a conveying belt of the inkjet recording apparatus of FIG. 1.

The conveying belt 33 in the present example is a continuous belt that is arranged around the drive roller 31 and the driven roller (tension roller) 32. The conveying belt 33 is configured to rotate in the direction of arrow A shown in FIG. 1 (paper conveying direction). The conveying belt 33 may have a single-layer structure, a dual-layer structure as is shown in FIG. 3, or a three-layer structure, for example. FIG. 3 is a cross-sectional diagram showing an exemplary structure of the conveying belt 33 having a first layer (surface layer) 33*a* and a second layer (inner layer) 33*b*. For example, the conveying belt 33 may include a surface layer as a paper attracting surface made of resin material that is not rheostatically controlled such as ETFE pure material having a pure thickness of approximately 40 μm and an inner layer (intermediate resistive layer, earth layer) made of the same resin material as the surface layer that is rheostaically controlled by carbon.

As is shown in FIG. 3, the charge roller 34 is arranged to come into contact with the surface layer 33*a* of the conveying belt 33 and be driven to rotate in response to the rotation of the conveying belt 33. It is noted that the charge roller 34 is applied a high voltage according to a predetermined pattern by a high voltage circuit or high voltage power source (not shown).

Also, a delivery roller 38 is arranged at the downstream side of the conveying mechanism 5 for delivering the recording paper 3 with an image recorded thereon to the delivery tray 6.

In the inkjet recording apparatus as is described above, the conveying belt 33 rotates in the direction of the arrow A shown in FIG. 1 to come into contact with the charge roller 34 that is applied a high potential voltage to be positively charged. In this case, the polarity of electrical charge of the charge roller 34 may be switched at predetermined time intervals so that it may charge the conveying belt 33 at a predetermined charge pitch.

When recording paper 3 is conveyed to the conveying belt 33 that is charged with high potential, the interior of the recording paper 3 is polarized. In turn, an electric charge that is of an opposite polarity of the electric charge of the conveying belt 33 is induced at the face of the recording paper 3 that is in contact with the conveying belt 33. The charge of the conveying belt 33 and the induced charge of the conveyed recording paper 3 in contact with the conveying belt 33 are statically attracted to each other, and the recording paper 3 is statically attached to the conveying belt 33. In this way, the recording paper 3 may be securely attached to the conveying belt 33 so that creases and warping of the recording paper 3 may be straightened (corrected) and a smooth planar surface may be realized.

Then, the conveying belt 33 is rotated to move the recording paper 3, and the recording head 14 is driven according to an image signal. Specifically, the recording head 14 is driven according to the image signal to discharge ink droplets (liquid droplets) on the recording paper 3 to record one line image when the recording paper 3 is in a still state, and record the next line image after the recording paper 3 is moved by a predetermined distance. The recording head 14 ends its recording operations upon receiving a recording end signal or a signal indicating that the rear end of the recording paper 3 has reached the recording region.

Then, the recording paper 3 with an image recorded thereon is delivered to the delivery tray 6 through the delivery roller 38.

Figure 4:
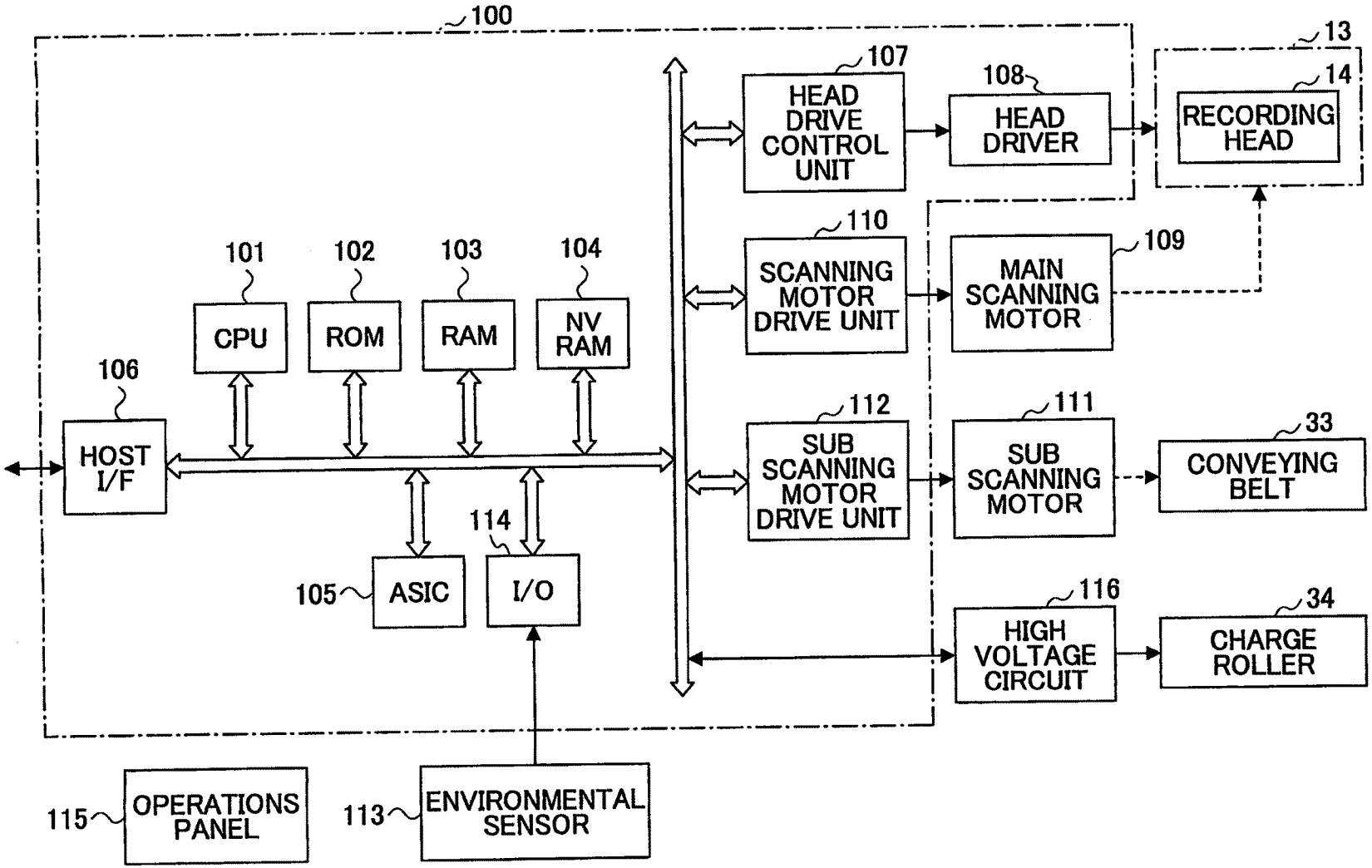
FIG. 4 is a block diagram showing a configuration of a control unit of the inkjet recording apparatus of FIG. 1.

In the following, a control unit of the inkjet recording apparatus according to an embodiment of the present invention is described. FIG. 4 is a block diagram showing a configuration of a control unit 100.

The control unit 100 includes a CPU 101, a ROM 102 that stores fixed data such as programs to be executed by the CPU 101, a RAM 103 that temporarily stores data such as image data, a nonvolatile memory (NVRAM) 104 that can hold on to data even when the power of the apparatus is turned off, and an ASIC 105 that processes input/output signals for controlling the apparatus, for example. It is noted that the ASIC 105 may be configured to realize a part of imaging processes for processing input image data particularly in a case where the recording apparatus corresponds to a 'high speed' recording apparatus as is described below.

The control unit 100 also includes a host I/F 106 for realizing data/signal transmission/reception with a host, a head drive control unit 107 for driving and controlling the recording head 14, a head driver 108, a main scanning motor drive unit 110 for driving a main scanning motor 109, a sub scanning motor drive unit 112 for driving a sub scanning motor 111, an environmental sensor 113 for detecting the environmental temperature and/or the environmental humidity, and an I/O 114 for inputting detection signals from various sensors (not shown), for example.

The control unit 100 is connected to an operations panel 115 for inputting and displaying required information for the apparatus. Also, the control unit 100 is configured to control the on/off switching and output polarity switching of a high voltage circuit (high voltage power source) 116 that is configured to apply a high voltage to the charge roller 34.

The host I/F 106 of the control unit 100 is configured to receive data such as print data including image data from the host via cable or a network. It is noted that the host may be an information processing apparatus such as a personal computer (PC), an image reading apparatus such as an image scanner, or an image capturing apparatus such as a digital camera, for example.

The CPU 101 is configured to read and analyze print data stored in a reception buffer of the host I/F 106, control the ASIC 105 to perform a data rearranging process, for example (and possibly a part of imaging processes as is described in detail below), and transmit image data to the head drive control unit 107. It is noted that conversion of the print data to bitmap data for realizing image output may be realized at the inkjet recording apparatus side by storing font data in the ROM 102, for example, or the image data may be developed into bitmap data by a printer driver at the host side and the bitmap data may be transmitted to the inkjet recording apparatus.

The head drive control unit 107 is configured to receive image data (dot pattern data) of one line image to be recorded by the recording head 14, synchronize the received one-line dot pattern data with a clock signal, transmit serial data corresponding to the synchronized image data and clock data to the head driver 108, and transmit a latch signal to the head driver 108 at a predetermined timing.

The head drive unit 107 includes a drive waveform generating circuit that may be made up of a ROM (e.g., ROM 102) that stores dot pattern data of a drive waveform (drive signal), a waveform generating circuit including a D/A converter that performs D/A conversion on the data of the drive waveform, and an amplifier, for example.

The head driver 108 includes a shift register that inputs serial data corresponding to image data and clock data from the head drive control unit 107, a latch circuit that latches a resist value of the shift register, a level converting circuit (level shifter) that changes the level of the output value of the latch circuit, and an analog switch array that is on/off controlled by the level shifter, for example. By performing on/off switching control on the analog switch array, relevant drive waveform of the drive waveform may be selectively applied to an actuator of the recording head 14 to drive the recording head 14.

In the following, processes performed at the host PC side and the inkjet recording apparatus side are described with reference to FIG. 5. It is noted that applications exist where the recording apparatus includes a storage medium reading mechanism and an image processing mechanism. Such a recording apparatus may be capable of outputting an image without connecting to a host PC; however, this type of recording apparatus is regarded as an extended application of the so-called instant camera for personal use. In applications for office use, for example, a host PC and a recording apparatus that are connected via a network are used as component parts of a recording system.

Figure 5:
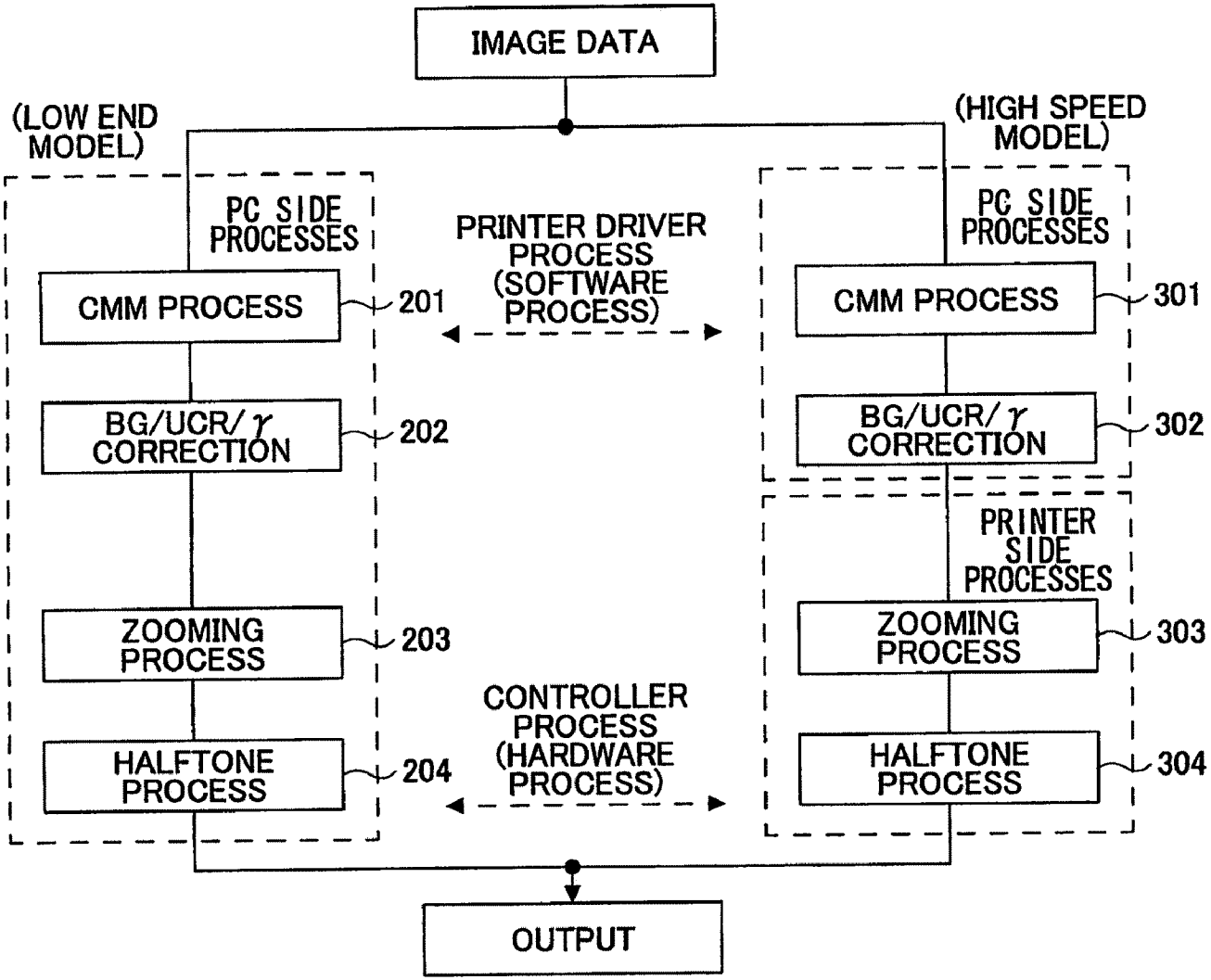
FIG. 5 is a block diagram showing a configuration of image processes performed at a host PC and the inkjet recording apparatus of FIG. 1.

FIG. 5 shows a low end model where all imaging processes are performed at the PC side and a high speed model where a part of the imaging processes are assigned to the ASIC included in the inkjet recording apparatus. In the high speed model shown in FIG. 5, the imaging processes are assigned to the host side and the recording apparatus side so that the time required for completing the imaging processes may be reduced, and the host PC may be freed in a shorter period of time.

However, it is noted that since a high performance ASIC (including a large capacity memory in some cases) has to be installed in the high speed model, the price of the high speed model may be higher than that of the low end model.

Imaging processes to be performed for outputting an image include a CMM (Color Management Module) process 201/301 for converting the color space of input image data from a color space for a monitor display to a color space for the recording apparatus (RGB color model→CMY color model); a BG/UCR/γ correction process 202/302 for performing BG/UCR (black generation/Under Color Removal) processes on CMY values and γ correction including input/output correction according to the specific characteristics of the recording apparatus and the particular preferences of the user, for example; a zooming process 203/303 for performing scaling processes on image data according to the resolution of the recording apparatus; and a halftone process (multi-value/threshold value matrix) 204/304 for replacing image data with dot pattern data based on which ink droplets are discharged from the recording apparatus to form dots.

In the following, exemplary cases of forming a monochrome image using an imaging method according to an embodiment of the present invention are described.

Figure 6:
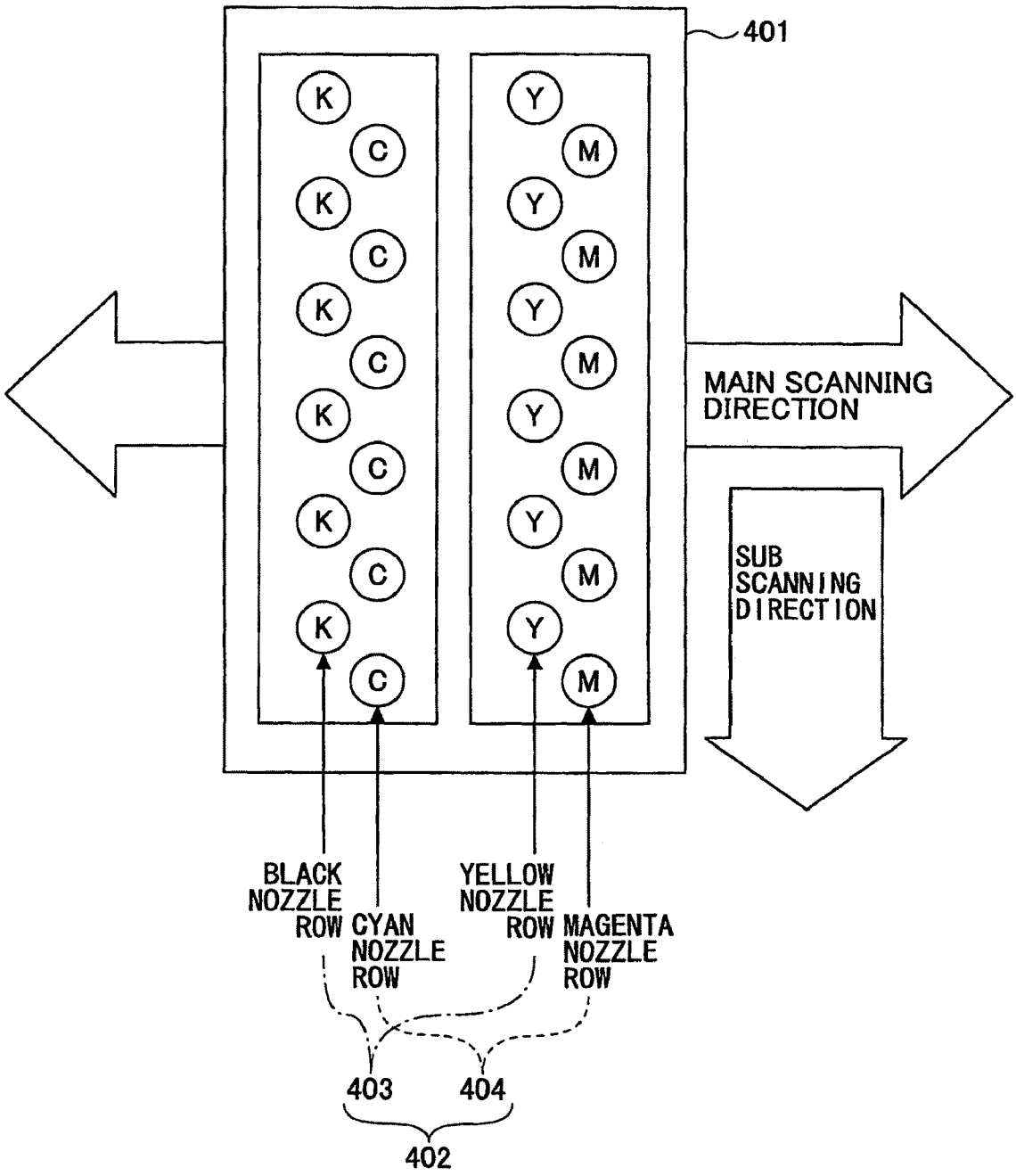
FIG. 6 is plan view showing the nozzle arrangement of a head unit of the inkjet recording apparatus of FIG. 1.

FIG. 6 is a plan view showing an exemplary nozzle arrangement of a head unit of the inkjet recording apparatus of the present embodiment. As is shown in this drawing, a head unit 401 of the inkjet recording apparatus according to the present embodiment includes four nozzle rows 402 extending in the sub scanning direction corresponding to the colors black (K), cyan (C), yellow (Y), and magenta (M). The nozzle rows 402 are subdivided into a first nozzle row group 403 including the black (K) nozzle row and the yellow (Y) nozzle row that have nozzles arranged on the same raster positions, and a second nozzle row group 403 including the cyan (C) nozzle row and the magenta (M) nozzle row that have nozzles shifted in the sub scanning direction from the nozzles of the first nozzle row group 403 by half the nozzle pitch. It is noted that the nozzle colors are not limited to black (K), cyan (C), yellow (Y), and magenta (M), and other colors may be added as well, for example. Also, the color arrangement order in the main scanning direction is not limited to that shown in FIG. 6.

In an imaging method according to an embodiment of the present invention, nozzles at a raster position on which the black nozzles are not arranged are configured to form a substitute dot for a black dot. Therefore, the nozzle colors of the second nozzle row group are preferably arranged to be colors that can produce a dark color close to black. Depending on different color combinations, namely, depending on which two colors are selected from the colors cyan (C), yellow (Y), and magenta (M), the substitute dot may be reddish (if a combination of cyan (C) and yellow (Y) is used), bluish (if a combination of cyan (C) and magenta (M) is used), or greenish (if a combination of yellow (Y) and magenta (M) is used). Although the preferred combination of colors for forming the black substitute dot depends on various factors such as the characteristics of the ink, the combination of cyan (C) and magenta (M) that realizes a bluish substitute dot is generally preferred.

Figure 7A:
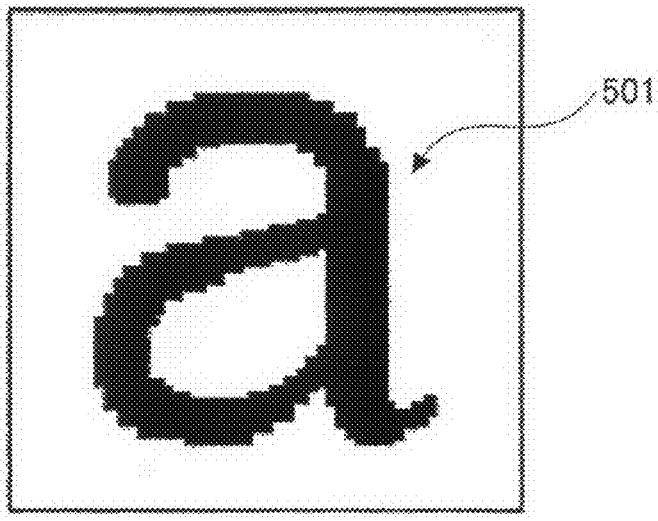
FIGS. 7A-7C are diagrams illustrating an imaging method according to an embodiment of the present invention.
Figure 7B:
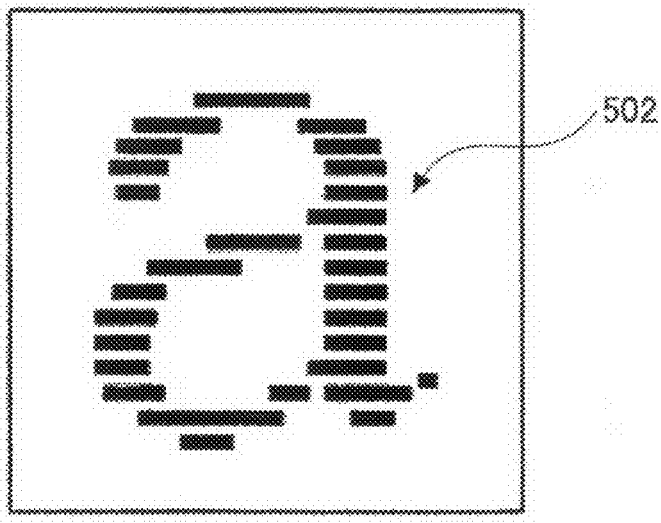
Figure 7C:
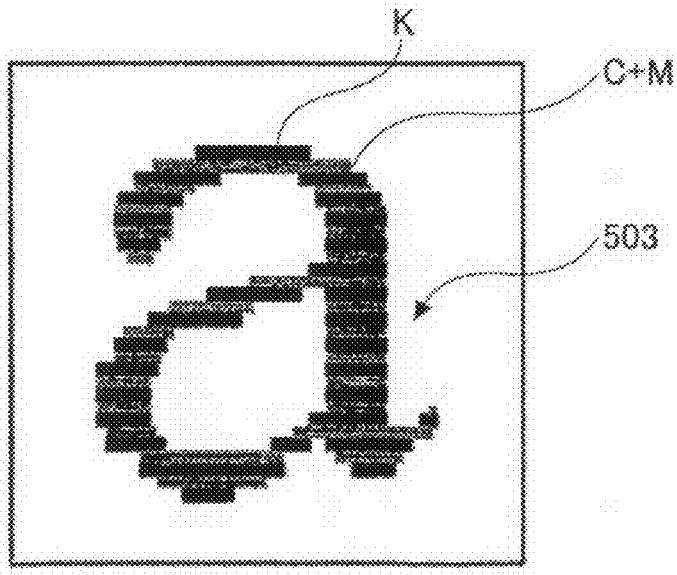

In the following descriptions, it is assumed that the head unit 401 as is illustrated in FIG. 6 is used in which the nozzles are arranged to realize the color order KCYM so that a bluish substitute dot is formed by cyan (C) and magenta (M). Also, the density of the nozzles with respect to the sub scanning direction is assumed to be 150 dpi. In FIG. 6, the yellow nozzles are arranged at the same raster positions as the black nozzles with respect to the sub scanning direction, and the cyan nozzles and the magenta nozzles are arranged at raster positions that are shifted from the nozzle positions of the black nozzles in the sub scanning direction by half the nozzle pitch (i.e., 300 dpi). FIGS. 7A-7C are diagrams illustrating the imaging method according to the present embodiment. FIG. 7A shows an image 501 with a dot pattern of 300 dpi. FIG. 7B shows a color image 502 such as a yellow image depicted by the head unit 401 of FIG. 6. In the present example, the head unit 401 of FIG. 6 forms a color image at a resolution of 150 dpi in the sub scanning direction to realize a dot pattern as is shown in FIG. 7B. FIG. 7C shows a monochrome image 503 depicted by the head unit 401 of FIG. 6. In this image, dots corresponding to a raster with no black nozzles are formed by cyan and magenta nozzles. In other words, the dot pattern of the monochrome image 503 shown in FIG. 7C is formed by discharging ink from the black nozzles as well as discharging ink from the cyan and magenta nozzles arranged at positions shifted from the black nozzles by 300 dpi. In this case, lines formed by cyan ink and magenta ink are disposed between black lines formed by black ink. The color of such lines formed by cyan and magenta is close to blue. Since the spaces between black lines are filled with blue, the gray balance of the image is deviated toward blue. However, the resolution of the image in the sub scanning direction may be doubled, and the image density may be increased in the present example.

In one preferred embodiment, the grey balance of the image may be improved by discharging yellow ink from a yellow nozzle that is positioned at the same raster position as a black nozzle forming a black dot. By forming a yellow dot at the same position as a black dot, the gray balance that is deviated toward blue may be adjusted back to black. According to another preferred embodiment, in a case where the head unit 401 is capable of changing ink droplet sizes, the ink droplet sizes of cyan and magenta may be adjusted to be smaller than the ink droplet size of black so that deviation of the black image toward blue may be reduced. In another embodiment, the ink droplet sizes of ink that does not affect the overall density of an image such as yellow ink may be reduced further in order to reduce the overall ink consumption amount.

FIGS. 8A-8C are tables illustrating preferred ink droplet sizes according to various conditions. As is shown in FIG. 8A, when the ink droplet size of black is large, and achieving a high image density is prioritized, the ink droplet sizes of the four colors black (K), yellow (Y), cyan (C), and magenta (M) may be arranged to be large (see Option 1). In a case where reduction of the ink consumption amount is desired while maintaining a high image density, the ink droplet size of yellow may be arranged to be medium, small, or null, and the ink droplet sizes of the other three colors may be arranged to be large (see Option 2). In a case where prevention of the gray balance deviation is desired, the ink droplet sizes of the three colors other than black are arranged to be medium (see Option 3). Also, in a case where prevention of the gray balance deviation and reduction of the ink consumption amount are desired, the ink droplet sizes of cyan and magenta may be arranged to be medium, and the ink droplet size of yellow may be arranged to be small or null (see Option 4). In a case where further reduction of the ink consumption amount is desired, the droplet sizes of cyan and magenta may be arranged to be small, and the ink droplet size of yellow may be arranged to be medium, small, or null (see Option 5). As is shown in FIGS. 8B and 8C, when the droplet size of black ink is medium/small, the ink droplet sizes of the colors other than black may similarly be arranged to be equal to or smaller than the ink droplet size of black according to the various conditions described above.

FIG. 9A is a table indicating the total ink consumption amounts according to the various conditions in the case of printing an image by adjusting the ink droplet sizes of color inks, and FIG. 9B is a table indicating the total ink consumption amount in the case of printing a monochrome image with just black ink as a comparison example. As can be appreciated from these tables, the total ink consumption amount in the case of printing a monochrome image with black ink as well as color inks may be adjusted to be greater than, equal to, or less than the total ink consumption amount in the case of using only black ink.

Figure 10:
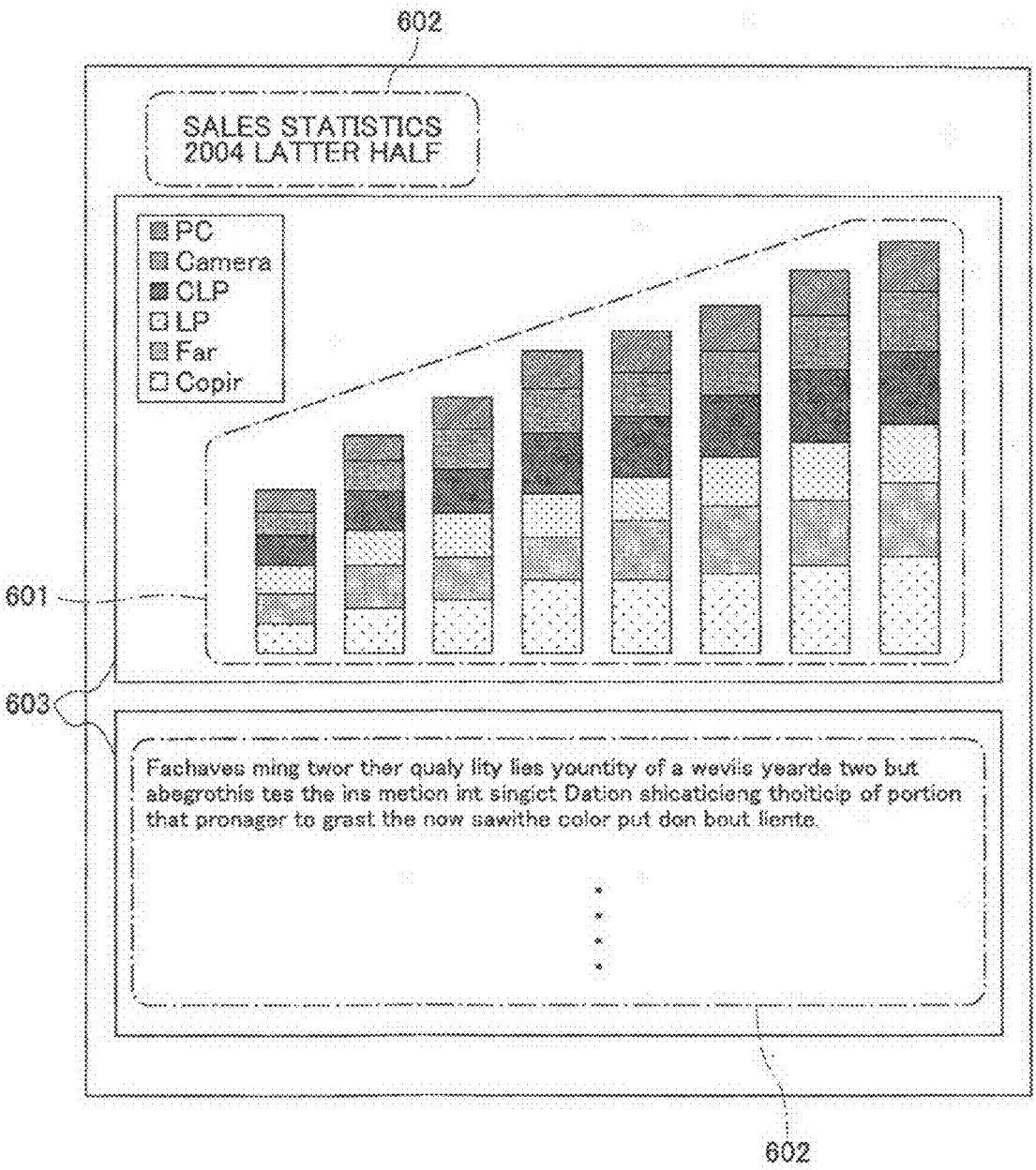
FIG. 10 is a diagram showing an image including image objects of different types and colors.

FIG. 10 is a diagram showing an example of an image including image objects of differing types and colors. The image of FIG. 10 includes graphics 601 corresponding to a color image portion, and characters 602 and lines 603 corresponding to monochrome image portions. In processing the image shown in FIG. 10, the characters 602 and lines 603 may be formed as a 300 dpi dot pattern image using black ink and color inks according to the imaging method of the present embodiment as is described above. In one embodiment, the graphics 601 may be formed as a 150 dpi dot pattern image, and even if black portions are included in the graphics 601, such black portions may be formed using just black ink at 150 dpi like the rest of the graphics 601. Also, in a case where the characters 602 are colored, the characters 602 may be printed as a 150 dpi dot pattern image.

Figure 11A:
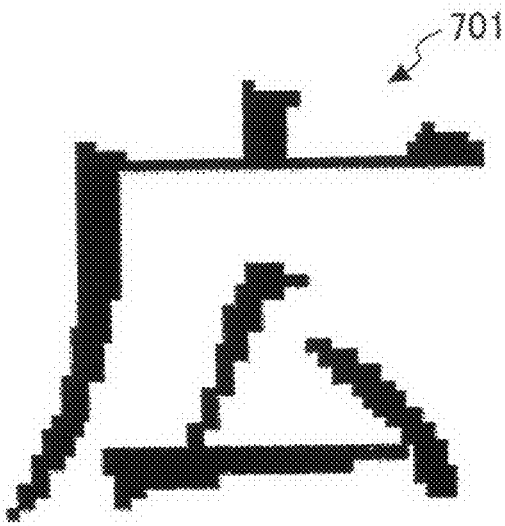
FIGS. 11A and 11B are diagrams illustrating an exemplary case of printing an image using the imaging method of the present embodiment.

FIGS. 11A-13B are diagrams illustrating exemplary cases of printing images according to the imaging method of the present embodiment. FIGS. 11A and 11B show images with 300 dpi dot patterns. In a case where the image 701 shown in FIG. 11A corresponds to a black character, the image 702 shown in FIG. 11B may be printed by assigning a portion of the dot pattern of the image 701 to color nozzles. In the image 702 shown in FIG. 11B, a dot pattern 702-1 corresponding to a horizontal line with a width of one dot is assigned to the cyan and magenta nozzles so that substitute dots formed by cyan and magenta inks make up the horizontal line. In this case, the horizontal line dot pattern 702-1 is printed as blue as opposed to black.

Figure 11B:
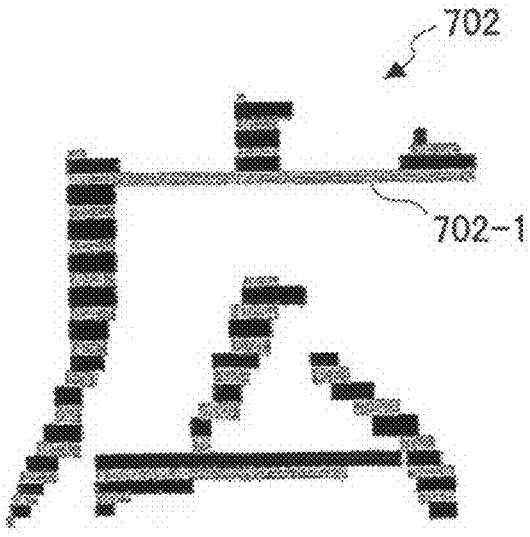
Figure 12A:
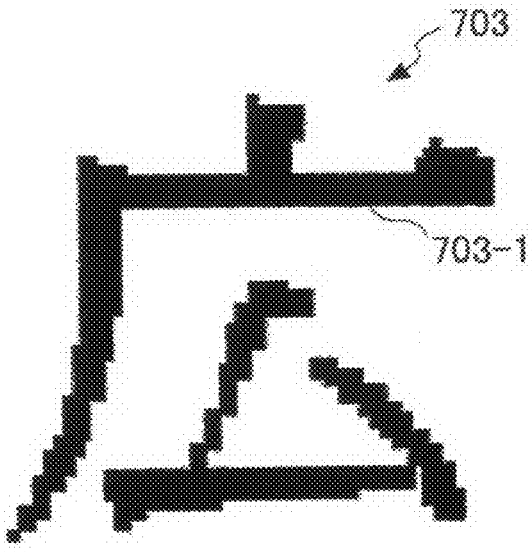
FIGS. 12A and 12B are diagrams illustrating another exemplary case of printing an image using the imaging method of the present embodiment.
Figure 12B:
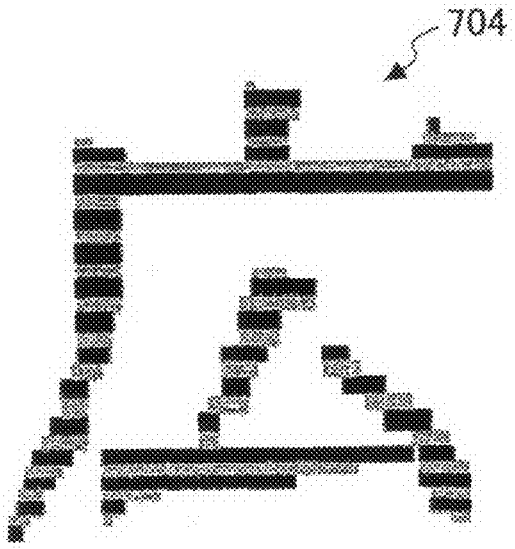

According to one embodiment, a pre-process may be performed on the image 701 of FIG. 11A to make the horizontal line wider by one dot width in the sub scanning direction so as to prevent a portion of a black character to be printed in blue as in the example of FIG. 11B. FIG. 12A shows an image 703 with a dot pattern 703-1 corresponding to a horizontal line dot pattern that has been widened. FIG. 12B shows an image 704 printed by assigning a portion of the dot pattern of the image 703 to color nozzles according to the imaging method of the present embodiment. As is shown in FIG. 12B, in the image 704, the single blue dot line of the image 702 shown in FIG. 11B is replaced by a corresponding horizontal line including black dots.

Figure 13A:
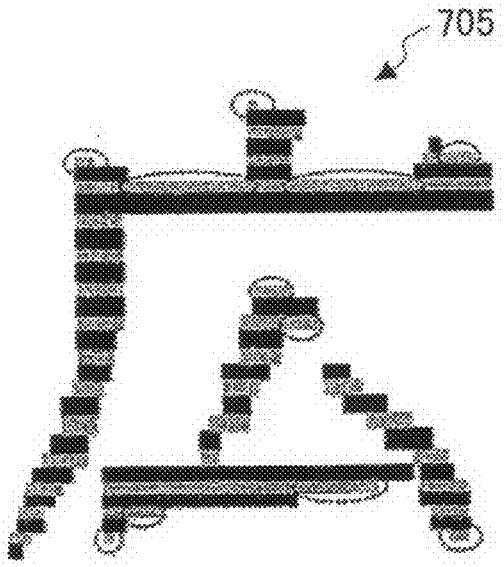
FIGS. 13A and 13B are diagrams illustrating another exemplary case of printing an image using the imaging method of the present embodiment.
Figure 13B:
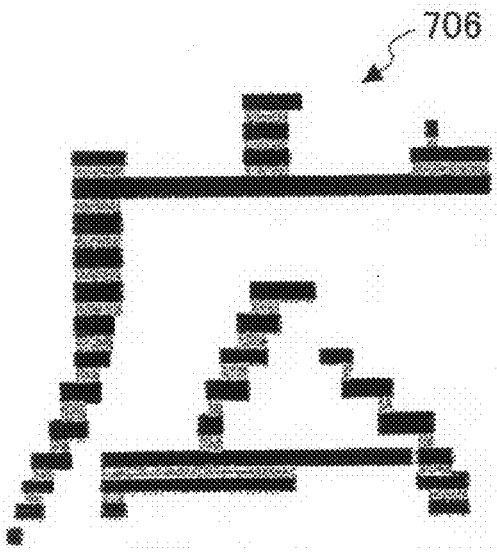

According to another embodiment, the color dots at image peripheral portions that are not positioned in between black dots may be reduced in size or not printed in order to prevent the color dots from standing out in the printed black character. FIG. 13A shows an image 705 with the color dots at the image peripheral portions being encircled by dotted lines. FIG. 13B shows an image 706 in which the color dots at the image peripheral portions are not printed.

As can be appreciated from the above descriptions, by using the imaging method according to the present embodiment, monochrome image objects such as characters and lines may be printed at a resolution in the sub scanning direction that is double the resolution in the sub scanning direction of a color image without decreasing the printing speed. Specifically, a monochrome image portion of an image may be formed at 300×300 dpi, and a color image portion of the image may be formed at 300×150 dpi, for example. Also, in another example, an image with an overall resolution of 300×300 dpi may be formed by increasing the number of printing passes (scan number) upon forming the color image portion of the image.

In the following, imaging processes according to different printing modes are described. FIG. 14 is a table indicating set values for realizing different printing modes using the imaging method according to the present embodiment. It is noted that in this table, 'pseudo black' refers to a black image that is formed using color nozzles as well as black nozzles to double the printing resolution in the sub scanning direction according to the imaging method of the present embodiment.

As is shown in FIG. 14, a 'high speed' printing mode may be subdivided into 'speed emphasis' mode for printing a black image portion at double resolution (300 dpi) while performing one-scan high speed printing; 'balanced' mode for printing a black image portion through one-scan printing and printing a color image portion through two-scan printing to obtain an image with an overall resolution of 300 dpi; and 'image quality emphasis' mode for performing two-scan printing to form a conventional 300 dpi dot pattern image. Other printing modes include a 'standard (speedy)' mode, a 'standard (fine)' mode, and a 'high image quality' mode. As can be appreciated from the resolutions and the number of scans indicated in the table of FIG. 14, these printing modes correspond to higher resolution printing modes with respect to the 'high speed' mode described above. It is noted that a suitable sub mode of the 'high speed' printing mode may be selected to compensate for differences in the characteristics of apparatuses, for example. In one specific example, with respect to an apparatus of a superior model that is capable of printing at 300 dpi through one-scan printing, the inkjet recording apparatus of the present example may be arranged to perform printing at the 'image quality emphasis' mode to form an image with image quality equivalent to that realized by the superior model through two-scan printing (in which case the printing speed is reduced to half); or alternatively, the 'speed emphasis' mode or the 'balanced' mode may be selected to maintain the printing speed of the apparatus.

Although the present invention is shown and described with respect to certain preferred embodiments, it is obvious that equivalents and modifications will occur to others skilled in the art upon reading and understanding the specification. The present invention includes all such equivalents and modifications, and is limited only by the scope of the claims.

The present application is based on and claims the benefit of the earlier filing date of Japanese Patent Application No. 2005-212620 filed on Jul. 22, 2005, the entire contents of which are hereby incorporated by reference.

The invention claimed is:

1. An imaging method for realizing full color printing, the method comprising:

providing an ink head configured to discharge black ink and a plurality of primary color inks of cyan, magenta and yellow, the ink head including a first nozzle row group and a second nozzle row group, the first nozzle row group including a black nozzle row having black nozzles for discharging the black ink and a color nozzle row having first color nozzles for discharging yellow ink, the first color nozzles for discharging the yellow ink being arranged at first scanning line positions that are same in a sub scanning direction as scanning line positions of the black nozzles of the first nozzle row group, and the second nozzle row group including color nozzle rows having second color nozzles for discharging at least two primary color inks other than the yellow ink, the second color nozzles for discharging the at least two primary color inks other than the yellow ink being arranged at scanning line positions that are shifted from the scanning line positions of the first color nozzles for discharging the yellow ink by half a nozzle pitch in the sub scanning direction, printing a monochrome image portion, in accordance with image data of a specific resolution in the sub scanning direction, by printing a plurality of first rasters by ejecting the black ink and the yellow ink through the first nozzle row group, in accordance with the image data of the specific resolution in the sub scanning direction, and printing a second raster in between the first rasters using pseudo black ink that is realized by ejecting a remaining number of the primary color inks through the second nozzle row group, in accordance with the same image data of the specific resolution in the sub scanning direction, such that the printed monochrome image portion has a recording resolution higher than the specific resolution in the sub scanning direction.

2. The imaging method as claimed in claim 1, comprising:

switching between printing the monochrome image portion using the black ink and the arbitrary number of the color inks, and printing the monochrome image portion using the black ink, the arbitrary number of the color inks, and the pseudo black ink depending on an image object type of the monochrome image portion.

3. The imaging method as claimed in claim 2, wherein the monochrome image portion is printed using the black ink, the arbitrary number of the color inks, and the pseudo black ink in a case where the monochrome image portion corresponds to at least one of a character or a line.

4. The imaging method as claimed in claim 1, wherein where the ink head is configured to adjust ink droplet sizes of the black ink and the color inks, and the ink droplet size of the black ink is arranged to be greater than or equal to the ink droplet sizes of the color inks upon printing the monochrome image portion.

5. The imaging method as claimed in claim 4, wherein the ink droplet sizes of the color inks are determined based on a dot arrangement pattern of the monochrome image portion.

6. The imaging method as claimed in claim 1, wherein the monochrome image portion is printed at a sub scanning resolution that is double a color image sub scanning resolution for printing a color image portion.

7. The imaging method as claimed in claim 1, wherein a number of scans performed by the ink head in a main scanning direction is changed depending on whether the monochrome image portion is printed or a color image portion is printed.

8. The imaging method as claimed in claim 1, wherein a dot printed using the pseudo black ink is positioned in at least one of:

(a) adjacent to a dot printed using the black ink; and (b) in between two dots printed using the black ink.

9. The imaging method as claimed in claim 1, further comprising:

forming a pseudo black line using the second color nozzles of the second nozzle row group to discharge two primary color inks, and discharging the black ink through the black nozzles of the first nozzle row group to form a black line, wherein the monochrome image portion is formed by a plurality of the pseudo black lines and a plurality of the black lines, if printing is performed at a high speed and a high resolution.

10. The imaging method as claimed in claim 1, wherein said at least two primary color inks discharged by the second color nozzles of the second nozzle row group are cyan ink and magenta ink.

11. An inkjet recording apparatus that forms an image on a recording medium, the apparatus comprising:

an ink head configured to discharge black ink and a plurality of color inks while moving back and forth in a main scanning direction that is perpendicular to a sub scanning direction corresponding to a conveying direction of the recording medium; and a control unit configured to control operation of the ink head;

wherein the ink head includes a first nozzle row group and a second nozzle row group, the first nozzle row group including a black nozzle row having black nozzles for discharging the black ink and a color nozzle row having first color nozzles for discharging yellow ink, the first color nozzles for discharging the yellow ink being arranged at first scanning line positions that are same in a sub scanning direction as scanning line positions of the black nozzles of the first nozzle row group, and the second nozzle row group including a plurality of color nozzle rows having second color nozzles for discharging the color inks other than the yellow ink, the second color nozzles for discharging the at least two primary color inks other than the yellow ink being arranged at scanning line positions that are shifted from the scanning line positions of the first color nozzles for discharging the yellow ink by half a nozzle pitch in the sub scanning direction; and the second nozzle row group is configured to perform pseudo black printing by printing a color dot as a pseudo black dot substituting a black dot of a monochrome image portion using at least two of the color nozzles positioned at a raster position of said black dot; and wherein the control unit causes the ink head to print a monochrome image portion, in accordance with image data of a specific resolution in the sub scanning direction, by printing a plurality of first rasters by ejecting the black ink and the yellow ink through the first nozzle row group, in accordance with the image data of the specific resolution in the sub scanning direction, and print a second raster in between the first rasters using pseudo black ink that is realized by ejecting an arbitrary number of the remaining primary color inks through the second nozzle row group, in accordance with the same image data of the specific resolution in the sub scanning direction, such that the printed monochrome image portion has a recording resolution higher than the specific resolution in the sub scanning direction.

12. The inkjet recording apparatus as claimed in claim 11, wherein switching is performed between printing the monochrome image using the first nozzle row group and printing the monochrome image portion using the first nozzle row group and the second nozzle row group depending on an image object type of the monochrome image portion.

13. The inkjet recording apparatus as claimed in claim 12, wherein the monochrome image portion is printed using the first nozzle row group and the second nozzle row group in a case where the monochrome image portion corresponds to at least one of a character or a line.

14. The inkjet recording apparatus as claimed in claim 11, wherein the ink head is configured to adjust ink droplet sizes of the black ink and the color inks, and the ink droplet size of the black ink is arranged to be greater than or equal to the ink droplet sizes of the color inks.

15. The inkjet recording apparatus as claimed in claim 14, wherein the ink droplet sizes of the color inks to be discharged by the color nozzles are determined based on a dot arrangement pattern of the monochrome image portion.

16. The inkjet recording apparatus as claimed in claim 11, wherein a sub scanning resolution of the monochrome image portion is arranged to be at least double a color image sub scanning resolution for printing a color image portion.

17. The inkjet recording apparatus as claimed in claim 11, wherein a number of scans performed by the ink head in the main scanning direction is changed depending on whether the monochrome image portion is printed or a color image portion is printed.

18. The inkjet recording apparatus as claimed in claim 11, wherein the color dot printed as the pseudo black dot by the second nozzle row group through pseudo black printing is arranged to be adjacent to a black dot printed with black ink by the first nozzle row group.

* * * * *